US010403244B2

(12) United States Patent
Chadwick et al.

(10) Patent No.: US 10,403,244 B2
(45) Date of Patent: Sep. 3, 2019

(54) APPARATUS AND METHODS FOR AN ADJUSTABLE BASS BRIDGE FOR A STRINGED MUSICAL INSTRUMENT

(71) Applicants: Richard Chadwick, Nashville, TN (US); Andrew Glasser, Bronx, NY (US)

(72) Inventors: Richard Chadwick, Nashville, TN (US); Andrew Glasser, Bronx, NY (US)

( * ) Notice: Subject to any disclaimer, the term of this patent is extended or adjusted under 35 U.S.C. 154(b) by 0 days.

(21) Appl. No.: 15/972,221

(22) Filed: May 6, 2018

(65) Prior Publication Data

US 2018/0322850 A1 Nov. 8, 2018

Related U.S. Application Data

(60) Provisional application No. 62/502,466, filed on May 5, 2017.

(51) Int. Cl.

| | |
|---|---|
| ***G10D 3/04*** | (2006.01) |
| ***G10D 3/14*** | (2006.01) |
| ***G10D 3/06*** | (2006.01) |

(52) U.S. Cl.
CPC ..... *G10D 3/04* (2013.01); *G10D 3/06* (2013.01); *G10D 3/14* (2013.01)

(58) Field of Classification Search
CPC ..... G10D 3/04; G10D 3/14; G10D 3/06
See application file for complete search history.

(56) References Cited

U.S. PATENT DOCUMENTS

2001/0011494 A1* 8/2001 Tamura ..... G10D 3/04 84/307

* cited by examiner

*Primary Examiner* — Kimberly R Lockett
(74) *Attorney, Agent, or Firm* — J. Curtis Edmondson; Law Offices of J. Curtis Edmondson

(57) ABSTRACT

An improved adjustable bridge is described for a stringed musical instrument. The adjustable bridge has a pair of feet attached to the bridge body. A pair of legs is attached for the bridge body using adjustable rod pegs. These rod pegs are adjustable so that the bridge may be moved upwards and downwards to achieve the desired bridge height.

17 Claims, 5 Drawing Sheets

APPARATUS AND METHODS FOR AN ADJUSTABLE BASS BRIDGE FOR A STRINGED MUSICAL INSTRUMENT

CROSS REFERENCE TO RELATED APPLICATIONS

This application claims benefit of U.S. Provisional Patent Application No. 62/502,466 filed on May 5, 2017, entitled as "Apparatus and methods for an adjustable bass bridge for a stringed musical instrument", which is incorporated herein by reference in its entirety.

FIELD

This invention is in the field of musical instruments and specifically for the apparatus and methods that improve the operational characteristics of adjustable bridges for musical instruments.

BACKGROUND

A bridge on an acoustical stringed instrument is mounted perpendicular to the strings and the top. The strings are strung and tightened across the bridge from the tailpiece to the head. The bridge displaces the strings above the fingerboard allowing the player to depress a string to shorten its length. As the string vibrates, either by a bow, strumming or plucking, the vibrating string creates sound.

Stringed instrumentalists appreciate improvements in bridge design means of changing the tension of the strings using the bridge. Several examples of adjustable bridges for stringed instruments have been described in the prior art. U.S. Pat. Nos. 1,447,174 and 2,082,951 issued to Grover illustrates a bridge for stringed musical instruments. U.S. Pat. No. 2,491,991 issued to Folke documents an improved bridge for stringed musical instruments with a supportive block. U.S. Pat. No. 2,455,452 issued to Eps describes a bridge specifically for bass violins. U.S. Pat. No. 3,443,467 issued to Richards describes a cylindrical upper and lower bridge setup for an eight-string guitar. U.S. Pat. No. 4,635,523 issued to Merchant describes spruce spring bridge support for stringed instrument. U.S. Pat. No. 3,539,700 issued to Johnson describes a bridge for violins with dual pickups.

Accordingly, there remains a continual need for the improved design of and construction of the adjustable acoustical instrument bridges.

SUMMARY

The present inventive subject matter in one of the embodiments describes an adjustable bridge of a stringed musical instrument having an upper portion equipped with a head piece a bottom portion, the bottom portion equipped with a pair of feet; and a body portion, the body portion connecting the upper portion to the bottom portion via a leg portion. The adjustable bridge of a stringed musical instrument also has detents for the placement of one or more strings in a saddle notches. The adjustable bridge of a stringed musical instrument also has a leg portion that is connected to the bottom portion interconnected by rod pegs that are fastened by a central nut. The adjustable bridge of a stringed musical instrument also has connecting rod pegs with a threaded structure for half of their length. The adjustable bridge of a stringed musical instrument also has feet of the thread that are threaded to receive the threaded portion of the connecting rod pegs. The adjustable bridge of a stringed musical instrument as also has a leg portion that is drilled to receive the unthreaded portion of the connecting rod pegs. The adjustable bridge of a stringed musical instrument where the height of the bridge is adjustable by threading the central nut in an upward or downward direction. The adjustable bridge of a stringed musical instrument where the head piece has a curved convex bottom and conforms to matching curved concave bridge body. The adjustable bridge of a stringed musical instrument also has a head piece with a thumbscrew knob to adjust the head piece in the curvature of the body portion.

Also described is a method for setting an adjustable bridge on a stringed musical instrument, with the steps of: placing the feet on the center of a top of the stringed musical instrument; then adjusting the feet position to align the center of bridge to a finger board; followed by rotating the top of bridge to achieve optimal and desired string height; and the adjusting the feet or leg height to achieve the desired string height.

REFERENCE CHARACTERS

Figure 3:
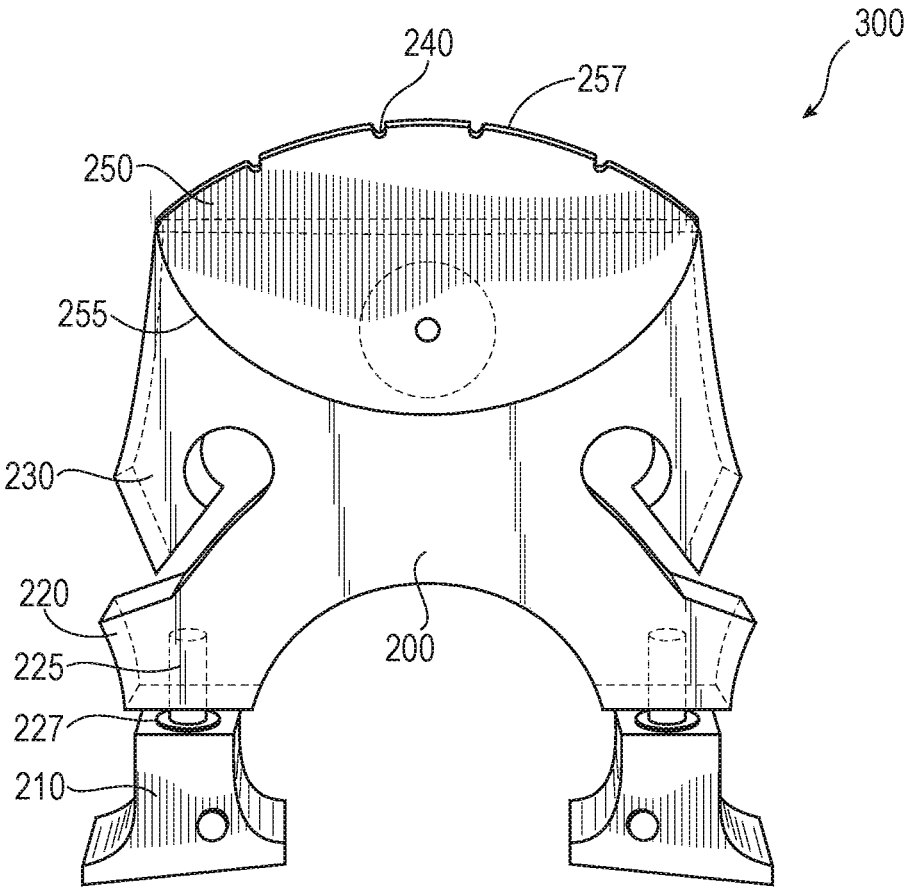
FIG. 3 illustrates a back-side view of the adjustable bridge.
Figure 4:
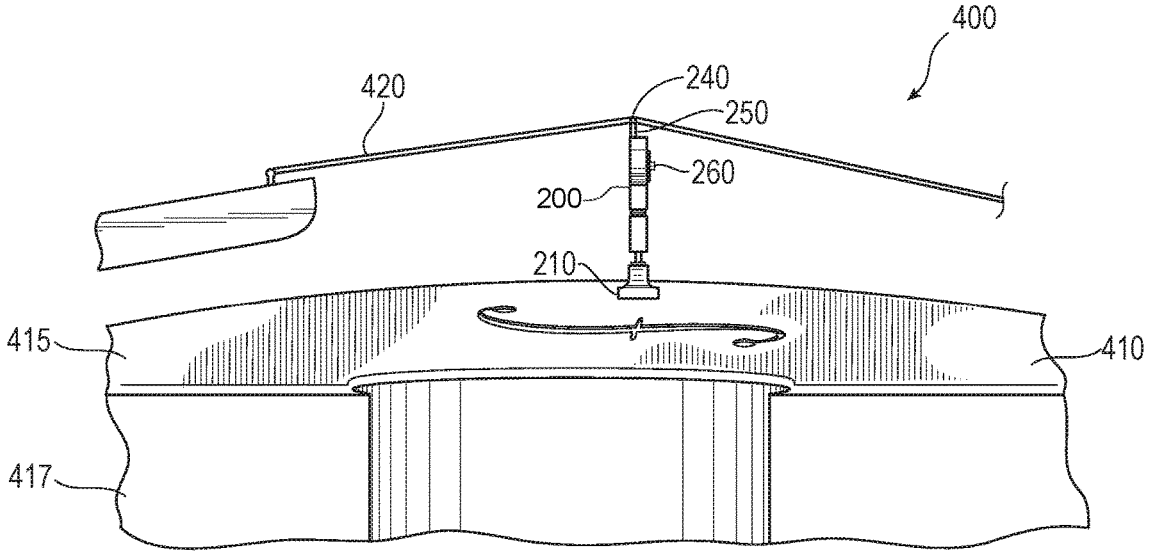
FIG. 4 illustrates a left side view of the adjustable bridge.

200 Improved Adjustable Bridge
210 Feet of the Bridge
220 Connection rod pegs
230 Body of the bridge
240 String spacing
250 Head piece
260 Adjusting knob for upper portion of the bridge
300 FIG. 3
400 Illustrates FIG. 4
500-560 Illustrates method steps

DETAILED DESCRIPTION

Figure 1:
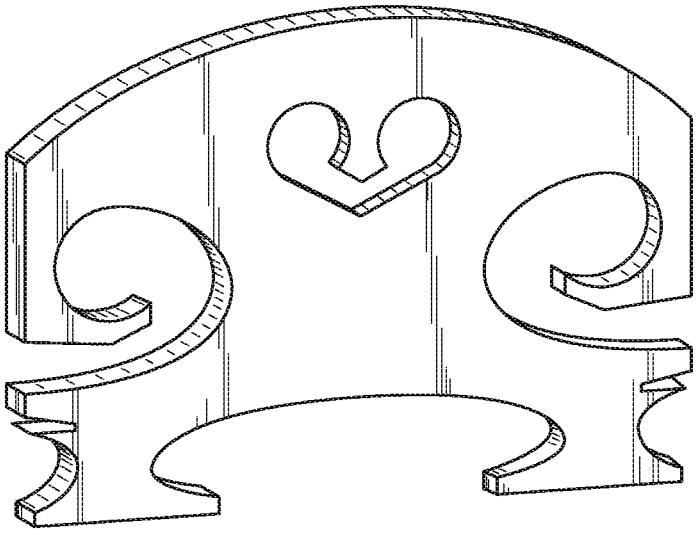
PRIOR ART Fig. 1
FIG. 1 illustrates a typical prior art bridge for stringed musical instruments.

A prior art bridge is shown on FIG. 1. Bridges are usually made from wood but are also made from other materials that have similar characteristics as wood. Alternatively, a bridge may consist of multiple interlocking parts.

Figure 2:
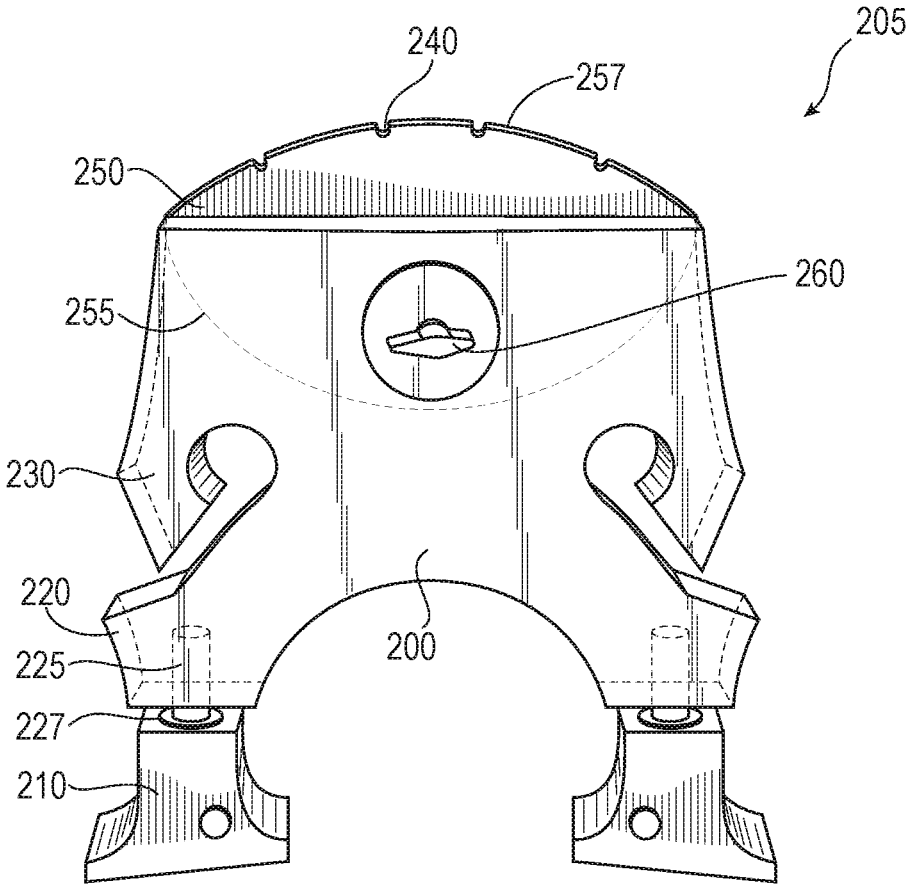
FIG. 2 illustrates a front side view of an adjustable bridge.

An improved adjustable bridge 200 is shown of the front view 205 of an adjustable bridge 200 for a stringed musical instrument in FIG. 2. The adjustable bridge has a pair of feet 210, a pair of leg 220 for the bridge body 230. A rod peg 225 that is threaded half of its length, with a central nut 227 fixed tight to the rod at the midpoint connects the leg 220 to its corresponding feet 210.

The distance between the feet 210 and the bridge body 230 can be adjusted by turning the rod pegs 225 in upwardly in clockwise direction or downwardly in anticlockwise direction via the central nut 227 to achieve the desired bridge height.

The feet 210 of the bridge are threaded to receive the threaded end of the rod peg 225, and the legs 220 of the bridge are drilled to receive the unthreaded end. The downward tension exerted by the strings on the legs of the bridge is sustained at the central nut 227. By turning the fixed nut, the distance between the bridge foot and leg can be changed, while the unthreaded end turns freely. Adjusting only one leg 210 causes the top of the bridge to tip away from that side and adjusting them equally causes the top of the bridge to raise or lower yet preserving the overall centering of the bridge.

The bridge body 230 hosts the head piece 250 with a curved bottom 255 and an arched upper portion 257 having the one or more string spacing or saddle 240. The position of the head piece 250 on the curved bottom can be adjusted by turning the thumb screw or knob 260, thereby individual string height can be varied without losing the arch shape 257 of the bridge and keeping the feet 210 positions intact. With the thumbscrew or knob 260 loose, the curved bottom of the head piece 250 can rotate to the left and right in the bridge body 230, because of the curvature, the top of the bridge remains centered relative to the main body 230, while it rotates, but the various string heights of the strings emerging from the spacing or saddle 240 will change relative to each other. A rear view 300 of the adjustable bridge 200 is shown as FIG. 3.

Now viewing the adjustable bridge 200 from the side view 400 is illustrated as FIG. 4, for a stringed musical instrument 410. A right-side view of the adjustable bridge 200 for the stringed musical instrument 410 mirrors that of the left side view 400. The partial structure of the stringed musical instrument shown in FIG. 4 and comprises a top plate 415 and peripheral walls 417 to form the sound box. Feet 210 are cut to fit the contour of top plate 415, so that the bridge seats securely, substantially perpendicular to the top plate surface 415. Further the saddle structures 240 of the head piece 250 host the one or more strings 420 of the stringed musical instrument. The face of the adjustable bridge 200 having the thumbscrew 260 is shown as facing the finger board in FIG. 4, in alternative embodiments the face of the adjustable bridge 200 having the thumbscrew 260 can face away from the finger board.

It can be appreciated from a person skilled in the art that the adjustable bridge can be made from variety of materials including, but not limited to wood, plastics, aluminum, or virtually any material that can vibrate sympathetically with the strings.

In an embodiment of the inventive subject matter, an apparatus for an adjustable bridge of a stringed musical instrument is described, including an upper portion, the upper portion equipped with a head piece, a bottom portion, the bottom portion equipped with a pair of feet and a body portion, the body portion connecting the upper portion to the bottom portion via a leg portion. The head piece hosts the one or more strings in a saddle notches. Further the leg portion is connected to the bottom portion by connecting rod pegs fastened by a central nut and the connecting rod pegs have a threaded structure for half of their length. The feet of the thread are threaded to receive the threaded portion of the connecting rod pegs and the leg portion is drilled to receive the unthreaded portion of the connecting rod pegs. Therefore, a height of the bridge is adjustable by threading the central nut in an upward or downward direction. Further, the head piece has a curved convex bottom and is received in a matching curved concave bridge body and the head piece further includes a thumbscrew knob to assist in the rotation of the head piece in the curvature of the body portion.

Figure 5:
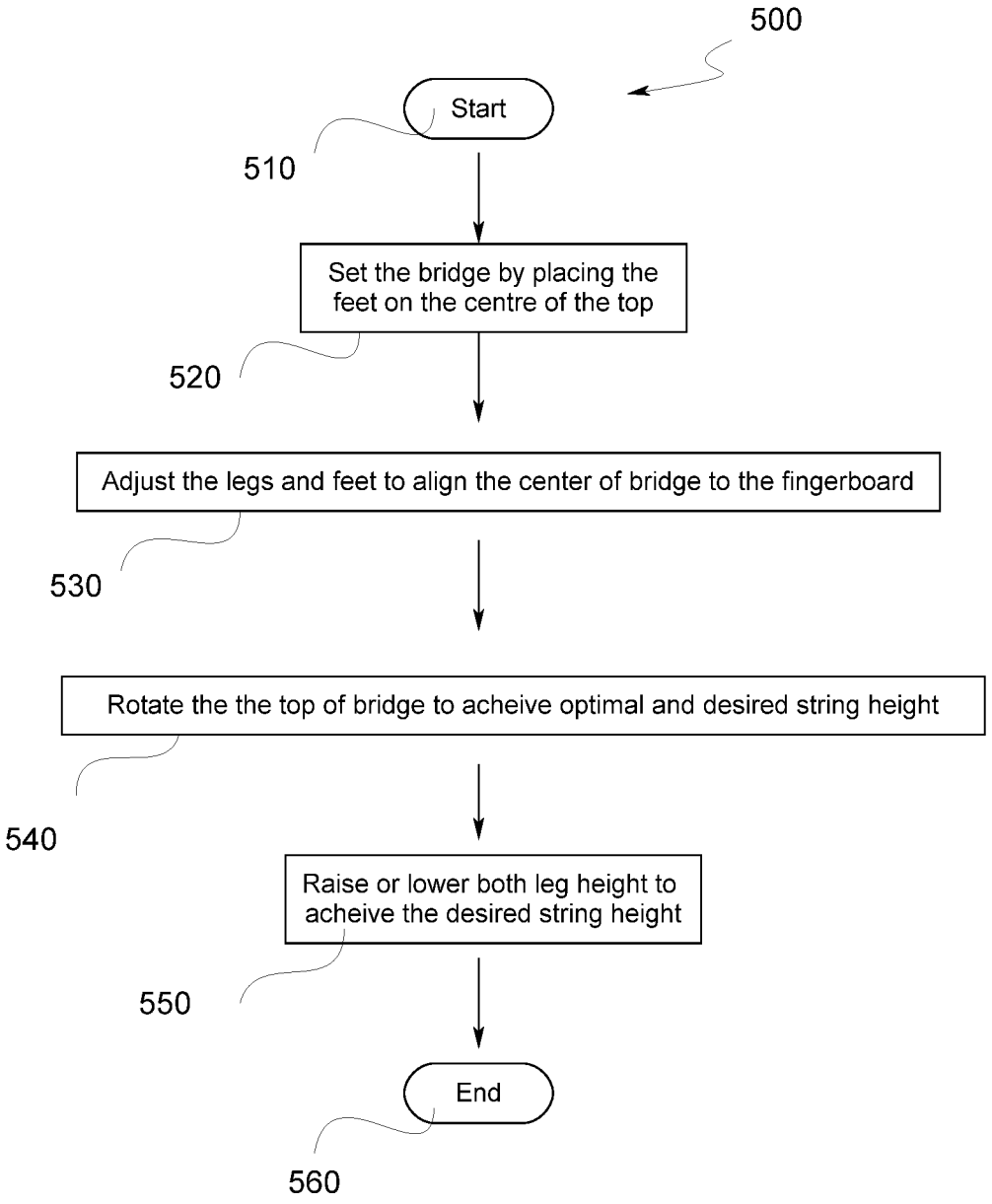
FIG. 5 illustrates the method steps for the operation and installation of the adjustable bridge.

The method of setting up the bridge is described on FIG. 5 the flow process 500 for setting up the bridge on a stringed musical instrument. The first step 510 to set up the bridge 520 on the top of a stringed instrument, by initially identifying a place on the top of the instrument that the bridge feet must be positioned for it to respond optimally, ideally aligned at a position with two notches cut into the top at the f-holes of the stringed instrument. The adjustable bridge is adapted to be placed on top of the instrument with only the string tension holding it in place.

The next step 530 involves to adjust the legs so that the strings are centered on the fingerboard. Followed by the step 540 to check the string height of the alternate strings to typically get a 2 mm variation and then at step 550 to adjust the leg height to achieve the desired string height to reach the finishing step 560 of method steps.

The many aspects and benefits of the invention are apparent from the detailed description, and thus, it is intended for the following claims to cover all such aspects and benefits of the invention which fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

The invention claimed is:

1. An apparatus for an adjustable bridge of a stringed musical instrument, comprising:

an upper portion, the upper portion equipped with a head piece;

a bottom portion, the bottom portion equipped with a pair of feet; and a body portion, the body portion connected to the pair of feet via a pair of legs; and wherein the head piece has a curved convex bottom and is received in a matching curved concave body portion.

2. The apparatus for the adjustable bridge of a stringed musical instrument as described in claim 1, wherein the head piece hosts one or more strings.

3. The apparatus for the adjustable bridge of a stringed musical instrument as described in claim 1, wherein the pair of legs is connected to the pair of feet by a pair of connecting rod pegs fastened by a central nut on each of the connecting rod peg.

4. The apparatus for the adjustable bridge of a stringed musical instrument as described in claim 3, wherein the pair of connecting rod pegs have a threaded structure for half of their length.

5. The apparatus for the adjustable bridge of a stringed musical instrument as described in claim 4, wherein the pair of feet is threaded to receive the threaded structure of the connecting rod pegs.

6. The apparatus for the adjustable bridge of a stringed musical instrument as described in claim 4, wherein the pair of legs are drilled to receive an unthreaded portion of the connecting rod pegs.

7. The apparatus for the adjustable bridge of a stringed musical instrument as described in claim 1, wherein a height of the bridge is adjustable by threading the central nut in an upward or downward direction.

8. A method for setting an adjustable bridge on a stringed musical instrument, comprising:

placing a feet on a center of a top of the stringed musical instrument;

adjusting a feet position to align a center of the bridge to a finger board;

rotating a top of the bridge to achieve a string height; and adjusting a feet or leg height to achieve the string height.

9. An apparatus for an adjustable bridge of a stringed musical instrument, comprising:

an upper portion, the upper portion equipped with a head piece;

a bottom portion, the bottom portion equipped with a pair of feet; and a body portion, the body portion connected to the pair of feet via a pair of legs; and wherein the head piece further includes a thumbscrew knob to assist in a rotation of the head piece in a curvature of the body portion.

10. The apparatus for the adjustable bridge of a stringed musical instrument as described in claim 1, wherein the curved convex bottom of the head piece is movable in a curvature of the concave body portion.

11. The apparatus for the adjustable bridge of a stringed musical instrument as described in claim 9, wherein a movement of the head piece in the curvature of the body portion leads to an adjustment of a height of one or more strings.

12. The apparatus for the adjustable bridge of a stringed musical instrument as described in claim 9, wherein a movement of the head piece in the curvature of the concave body portion leads to a relative adjustment of a height of one or more strings without losing an arch shape.

13. The apparatus for the adjustable bridge of a stringed musical instrument as described in claim 7, wherein a height of the bridge is adjustable upwardly by threading the central nut in a clockwise direction.

14. The apparatus for the adjustable bridge of a stringed musical instrument as described in claim 7, wherein a height of the bridge is adjustable downwardly by threading the central nut in an anticlockwise direction.

15. The apparatus for the adjustable bridge of a stringed musical instrument as described in claim 9, wherein a face of the bridge having a thumbscrew is facing a finger board of the stringed musical instrument.

16. The apparatus for the adjustable bridge of a stringed musical instrument as described in claim 9, wherein a face of the bridge having the thumbscrew is facing away from a finger board of the stringed musical instrument.

17. An apparatus for an adjustable bridge of a stringed musical instrument, comprising:

a pair of feet;

a body portion, the body portion connected to the pair of feet by a pair of legs via a pair of rod pegs and a central nut on each of the rod peg; and the body portion comprising a head piece, the head piece having a curved convex bottom and an arched upper portion with one or more saddle for receiving a string, the curved convex bottom of the head piece being received in a matching curved concave body portion and the head piece equipped with a thumb screw knob for retaining a position of the head piece in a curved concave body portion.

* * * * *